US009777437B2

(12) United States Patent
Lawandy et al.

(10) Patent No.: US 9,777,437 B2
(45) Date of Patent: Oct. 3, 2017

(54) SYSTEMS AND METHODS FOR REVERSING BANKNOTE LIMPNESS

(71) Applicant: Spectra Systems Corporation, Providence, RI (US)

(72) Inventors: Nabil Lawandy, Saunderstown, RI (US); Paul Byrne, Warwick, RI (US)

(73) Assignee: Spectra Systems Corporation, Providence, RI (US)

( * ) Notice: Subject to any disclaimer, the term of this patent is extended or adjusted under 35 U.S.C. 154(b) by 0 days.

(21) Appl. No.: 14/501,145

(22) Filed: Sep. 30, 2014

(65) Prior Publication Data

US 2016/0090696 A1 Mar. 31, 2016

(51) Int. Cl.

| | |
|---|---|
| ***C23C 26/00*** | (2006.01) |
| ***D21H 25/06*** | (2006.01) |
| ***D21H 25/00*** | (2006.01) |
| ***D21H 21/40*** | (2006.01) |
| ***D21H 17/00*** | (2006.01) |
| ***D21H 17/06*** | (2006.01) |
| ***D21H 17/36*** | (2006.01) |

(52) U.S. Cl.

CPC ..... *D21H 25/06* (2013.01); *D21H 17/06* (2013.01); *D21H 17/36* (2013.01); *D21H 17/72* (2013.01); *D21H 21/40* (2013.01); *D21H 25/005* (2013.01)

(58) Field of Classification Search

CPC ..... B01D 11/0203
USPC ..... 427/11
See application file for complete search history.

(56) References Cited

U.S. PATENT DOCUMENTS

2005/0260402 A1* 11/2005 Wang ..... H01L 21/31058 428/318.4
2007/0151582 A1 7/2007 Kin et al.
2008/0311752 A1* 12/2008 Sharma ..... C11D 11/0047 438/694
2010/0230947 A1* 9/2010 Crane ..... D21H 21/16 283/108
2012/0121459 A1 5/2012 Edgington et al.
2014/0116474 A1* 5/2014 Lawandy ..... B08B 7/0021 134/34

OTHER PUBLICATIONS

Lawandy et al. Supercritical Fluid Cleaning of Banknotes, I&EC Research, ACS publicaitions, Dec. 2013,pp. A-K.*
Written Opinion of the International Searching Authority in PCT/US2015/053246(dated Jan. 22, 2016).

* cited by examiner

*Primary Examiner* — Kelly M Gambetta
(74) *Attorney, Agent, or Firm* — Pryor Cashman LLP

(57) ABSTRACT

A method for enhancing the structural strength of a porous substrate having pores therein is disclosed. The method includes soaking the porous substrate in a solution having a first solvent and at least one polymer dissolved in the first solvent at a specific temperature and pressure, such that the solution is deposited within pores of the porous substrate, soaking the porous substrate in a second solvent, such that the first solvent diffuses into the second solvent, and such that the at least one polymer remains within the pores of the porous substrate, and flushing out the second solvent from the porous substrate.

20 Claims, 7 Drawing Sheets

SYSTEMS AND METHODS FOR REVERSING BANKNOTE LIMPNESS

TECHNICAL FIELD

The present invention relates generally to systems and methods for enhancing the structural strength of documents such as such as banknotes without inducing damage thereof. More specifically, the present invention relates to systems and methods that use impregnation of polymers to reverse the limpness of secure documents or banknotes without damaging their visual data, inks, substrates or security features.

BACKGROUND OF THE INVENTION

High security documents such as banknotes have substrates formed from various materials. In the United States, paper currency is made from a non-woven combination of 75% cotton and 25% linen fibers. In most other countries, pulp and cotton-based substrates are used. Some countries, such as Canada, have used cotton and paper blended banknotes. In addition, countries such as Australia, New Zealand and Canada have issued banknotes having polymer substrates, e.g., substrates including biaxially oriented polypropylene. The substrate, which may include one or more plies of the substrate material, may include security features such as laminated polymer or paper security threads, planchettes, and watermarks formed directly into the substrate. For example, U.S. paper currency contains a security tape or thread that is embedded within the banknote paper.

Banknotes also include visual data printed on the substrates. The visual data may include images such as portraits, authentication information such as serial numbers, or both. The inks used to print on the substrates may include special dry color pigments blended with oils and extenders and phosphor chips containing layered micro-interference layers. Such inks include Flexo inks, gravure inks, and thicker intaglio inks.

High security documents such as banknotes are generally formed on substrate materials that are frequently equipped with security elements, which are difficult to imitate and which permit even a layman to check the authenticity of the printed information or the document. Security elements can be, for example, windowed security threads, which are visible in certain areas on the surface of the banknote, applied foils, which have a transparent or metallized embossed hologram, blind embossings, so-called "latent images" produced by printing technology or by printing and embossing technology, which render different information from different viewing angles, prints containing optically variable pigments and producing different color effects depending on the viewing angles, and prints comprising metallic effect ink, which have metallic luster, for example, in a gold, silver or bronze tone. In addition to these unaided features, there are quasi-public security threads, fibers and inks, which fluoresce or phosphoresce under illumination with ultraviolet ("UV") or infrared ("IR") sources.

Other security features in paper currency include numeric watermarks, Guilloche patterns, which are narrow geometric patterns created by a geometric lathe or mathematically, microprinting, digital watermarks, magnetic inks and threads, demetalized security threads, holographic features, fluorescent inks, lenticular lens array security threads, and fluorescent and non-fluorescent security threads.

High level covert security features include ENIGMA (De La Rue International) and M (Geiseke and Devrient). An important security feature in currency is the M feature, where "M" refers to "machine readable." The M feature is a colorless, inorganic oxide integrated into the paper substrate, the printing ink, security ink, or a security thread, without causing any change in the appearance of the banknote. The powdered M feature may be blown into the paper substrate in a trail to identify a particular banknote denomination. When exposed to a flash from a strong source of light, the M feature emits a band of light in a split second that rapidly disappears. This repeatable, characteristic light band of the banknote can be authenticated by a reading device. The central banks protect the security of the M feature by requiring the use of special sensors to recognize it.

As counterfeiters have become more sophisticated, the security features in such documents have had to become more advanced as well in order to prevent widespread fraud. As the substrates of such secure documents have become more advanced, the cost to produce them has also increased, thus making the replacement of worn currency quite expensive. Therefore, it is important that in addition to being secure, such documents must have a high level of durability.

Banknotes are removed from circulation for a variety of reasons, including, but not limited to damage caused by mechanical wear and tear. For example, as banknotes are circulated, they tend to become limp and more prone to damage.

Banknotes have a finite time in circulation due to soling and tearing of the notes in use by the public. For example, it takes about 4,000 double folds (first forward and then backward) before a U.S. paper bill will tear. Banknotes are handled in many ways during their usable life and experience a variety of mechanical stresses, as well as being brought into contact with substances that can dirty the notes, resulting in difficulty in their authentication and use.

In order to improve durability of these substrates, it is known to use documents of value with a dirt-repellent and/or moisture resistant protective layer to extend the documents' lifetime and fitness for circulation. Such a protective layer typically contains cellulose ester or cellulose ether for the greater part and micronized wax for a lesser part, and is applied all over the banknotes. The micronized wax is dispersed by kneading or mixing with oil, an ink binder or a mixture thereof. The sheets freshly printed with the protective layer can be stacked without difficulties and without any black ink from one sheet staining the sheet below.

Another coating composition containing only a binder and no fillers has been applied to the banknote paper, which has a large surface area or high surface roughness due to its porosity. The composition is applied in a layer and has a thickness with a smooth surface, thus having little possibility for resulting dirt deposits. Further, the coating is thin enough not to impair the other stated properties of the paper.

A problem with this approach is that known protective layers do not last or wear well. Conventional protective layers comprising water-based lacquers usually fail to completely meet a demanding requirement profile. For example, very good dirt repellence and adhesion qualities contravene resistance to the penetration of liquid, and vice versa. Water-based lacquers, therefore, currently meet the high requirements for a protective layer in security printing, and in particular banknote printing, only if a second component in the form of a crosslinking agent is added.

Another problem relating to banknotes is that central banks need to replace worn and soiled notes at a cost to taxpayers. In the United States, the volume of notes manufactured is in the billions of notes per year (4-8 billion typically). The production of banknotes is costly, particularly so for the higher denominations, which have many security features that are both accessible to the public and machine readable by bill acceptors and the central banks using high speed sorters. Banknote sorters made by Geiseke and Devrient, De La Rue International and Toshiba typically process banknotes at rates of 10-40 banknotes/second and perform a number of diagnostics using sensors in the notes' travel path. These sensors are a combination of authentication sensors as well as note fitness sensors. The fitness sensors primarily use imaging and analysis of the captured images to determine if the banknote should be destroyed or returned to circulation.

The cost of replacing banknotes is significant as the higher denominations contain Level I, II and III security features for use by the public, commercial banks, single note acceptor devices and central banks. In the United States, for example, the currency replacement budget is $747 million and breaks down as follows:

$1 and $2 notes—5.2 cents per note $5 and $10 notes—8.5 cents per note $20 and $50 notes—9.2 cents per note $100 note—7.7 cents per note $100 note to be released in October 2013—13 cents per note With over 150 billion new banknotes being manufactured and printed every year around the world, the cost of replacement of unfit currency has approached $10 billion annually. In addition to the replacing the notes, there is a sizable waste disposal cost associated with the destruction of the shredded notes that are determined to be unfit. This amounts to about 150,000 tons of waste worldwide annually, based on total worldwide circulation of 150 billion notes. This is particularly problematic for polymer notes, which also pose larger environmental problems with respect to burning and landfill disposal.

Based on these facts, there is a need to employ a manner for improving the durability of banknotes which may become limp that does not attack the print and security features of the note, such as enhancing the structural strength the banknotes by reversing their limpness.

SUMMARY OF THE INVENTION

It is an object of the present invention to provide a method for enhancing the structural strength of a porous substrate having pores therein. It is a further object of the present invention to provide a method for cleaning and enhancing the structural strength of a document having a security feature, the document including a porous substrate having pores therein.

In general, in one aspect, the invention feature a method for enhancing the structural strength of a porous substrate having pores therein. The method may include soaking the porous substrate in a solution having a first solvent and at least one polymer dissolved in the first solvent at a specific temperature and pressure, such that the solution is deposited within pores of the porous substrate, soaking the porous substrate in a second solvent, such that the first solvent diffuses into the second solvent, and such that at least one polymer which is insoluble in the second solvent remains within the pores of the porous substrate, and flushing out the second solvent from the porous substrate.

Implementations of the invention may include one or more of the following features. The second solvent may be the first solvent at a different temperature and pressure such that the polymer exhibits a different solubility. The porous substrate may be a document including a security feature. The document may be a banknote. The method may include cleaning the porous substrate with a supercritical fluid. The first solvent may include ethanol. The second solvent may include water, acetone, or a supercritical fluid. The polymer may be a high molecular-weight polymer. The polymer may be polyvinyl alcohol (PVA), polyethylene oxide (PEO), or polyethylene glycol (PEG). Flushing out the second solvent may include evaporating. Flushing out the second solvent may include treating the porous substrate with a supercritical fluid.

In general, in another aspect, the invention features a method for cleaning and enhancing the structural strength of a document having a security feature, the document including a porous substrate having pores therein. The method may include soaking the document in a solution having a first solvent and at least one polymer dissolved in the solvent, such that the solution is deposited within pores of the porous substrate, soaking the document in a second solvent, such that the first solvent diffuses into the second solvent, and such that the at least one polymer remains within the pores of the banknote, flushing out the second solvent from the document, and cleaning the document with a supercritical fluid, such that the security feature is not deteriorated.

Implementations of the invention may include one or more of the following features. The second solvent may be the first solvent at a different temperature and pressure such that the polymer exhibits a different solubility. The step of cleaning the document may occur prior to soaking the document in the solution. The step of cleaning the document may occur after soaking the document in the solution. The second solvent may be the supercritical fluid, and wherein the step of cleaning the document occurs when the document is disposed in the supercritical fluid. The first solvent may include ethanol. The second solvent may include water. The second solvent may include acetone. The polymer may be polyvinyl alcohol (PVA), polyethylene oxide (PEO), or polyethylene glycol (PEG).

BRIEF DESCRIPTION OF THE DRAWINGS

The above-mentioned and other aspects, features and advantages can be more readily understood from the following detailed description with reference to the accompanying drawings, wherein.

DETAILED DESCRIPTION OF THE PREFERRED EMBODIMENTS

The present invention provides for systems and methods for enhancing the structural strength of documents, such a secure documents and banknotes. More specifically, the present invention provides for systems and methods of reversing the limpness of documents, including, but not limited to, secure documents and banknotes in a manner that does not damage or otherwise compromise the visual data, inks, substrates or the security features contained therein. The systems and methods disclosed herein should not be limited to secure documents and banknotes. Rather, the systems and methods disclosed herein may be used to reverse the limpness of any porous substrate that may require strengthening.

Generally, an important parameter used to determine the fitness of banknotes may be limpness. When banknotes have been in circulation, the mechanical wear from folds, handling, and use in bill acceptors, results in a loss of mechanical elasticity that leads to the notes becoming limp. Another important parameter used to determine the fitness of banknotes may cleanliness, i.e., the amount of soil on the banknotes. Accordingly, the systems and methods disclosed herein for reversing the limpness of banknotes may be combined with systems and methods for cleaning the banknotes.

Figure 1:
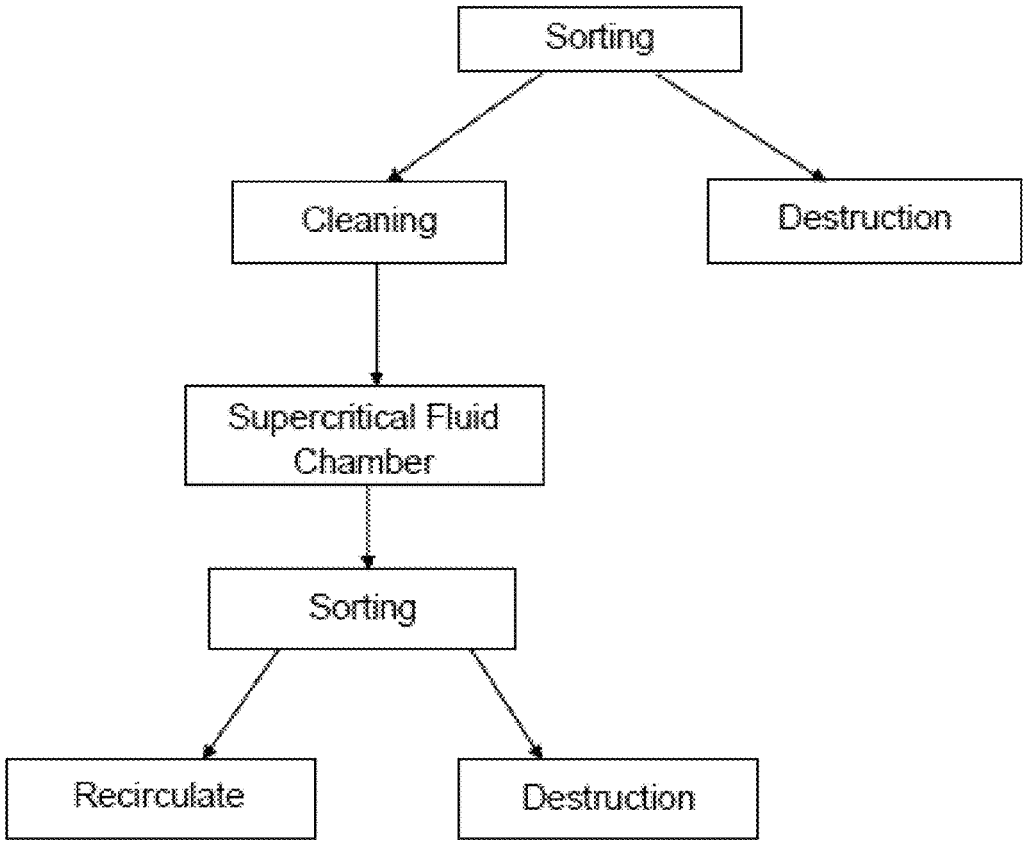
FIG. 1 is a flow chart showing the process of cleaning and sorting of banknotes in accordance with an embodiment of the present invention.

For example, FIG. 1 is a flow chart illustrating a system for cleaning banknotes according to an exemplary embodiment. FIG. 1 shows that the system may be configured to be used with at least one supercritical fluid for cleaning banknotes and secure documents. Generally, supercritical fluids mixed with other gases and additives, including ionic liquids, may be effective solvents for a variety of organics and have been used in a number of cleaning and extraction applications including pharmaceutical manufacturing, perfume production, and decaffeination. Accordingly, in the embodiments of the present invention, any supercritical fluid known to those skilled in the art may be employed, so long as the supercritical fluid may be configured to aid in cleaning banknotes and secure documents.

Examples of supercritical fluids that may be used alone or in combinations thereof include, but are not limited to, $CO_2$, $N_2O$, CO, $SF_6$. In particular, $CO_2$ may be a supercritical fluid used alone or in combination with trace amounts of other supercritical fluids, including, but not limited to, $N_2O$, CO, and $SF_6$. For example, $N_2O$ creates a degree of solubility in the system that cannot be accomplished with $CO_2$ alone, and $SF_6$ may be particularly useful in a cleaning system because of its highly electronegative properties.

An advantage of using supercritical fluids in the cleaning process may be that the security features on the bank notes may be either totally unaffected or weakly diminished by the cleaning process. Notably, the magnetic inks, fluorescence of UV active features, holograms, metalized and de-metalized threads, and optically variable inks may all remain intact and functioning after the cleaning process.

Additives may be combined with supercritical fluids to enhance cleanliness and other properties of banknotes and secure documents during the cleaning process. The additives may include, but are not limited to, mixtures of oxalic acid and water, methanol and/or ethanol, aqueous citric acid solutions, ammonium zirconium carbonate (AZC), and combinations thereof. In addition, the amount of additive(s) combined with the supercritical fluid(s) may be any desired amount known to those skilled in the art so long as the amount of additive(s) enables a desired result to be achieved. In one embodiment, for example, the additive(s) may be approximately 10% by volume to the fluid phase of the supercritical fluid.

The additive(s) combined with the supercritical fluid(s) during the banknote cleaning process may be chosen based on the state of the banknotes prior to cleaning and/or the desired state of the banknotes after cleaning. For example, if the banknotes to be cleaned include marks from writing implements (e.g., pens or markers), an additive may be chosen that includes a mixture of oxalic acid and water and/or methanol. Particularly, experiments have shown that saturated solutions of oxalic acid in water may be effective for removing gel pen markings; saturated solutions of oxalic acid in methanol or ethanol may be effective for removing permanent marker markings; and mixtures of oxalic acid with water/methanol may be effective for removing ball point pen markings, as well as gel pen markings and permanent marker markings.

Returning to FIG. 1, the system may include a sorting machine, such as those used by central banks that may include optical and mechanical inspection systems to investigate the banknotes to determine if they must be destroyed or can be sent back into circulation. In particular, such high speed sorting machines can be used to interrogate banknotes for both authenticity and fitness. The sorting machine of the present invention may include fitness sensors that may be configured to operate primarily on optical image analysis and examine a number of parameters including, but not limited to, tears, tapes, graffiti, soiling, and combinations thereof.

In addition, in some embodiments, the fitness sensors may be configured to determine banknote limpness using acoustics and/or ultrasonic reflection. Banknotes that are determined to have a limpness factor and/or cleanliness factor below pre-determined thresholds may be placed into a chamber where processes for cleaning and/or reversal of banknote limpness may be performed.

Figure 2A:
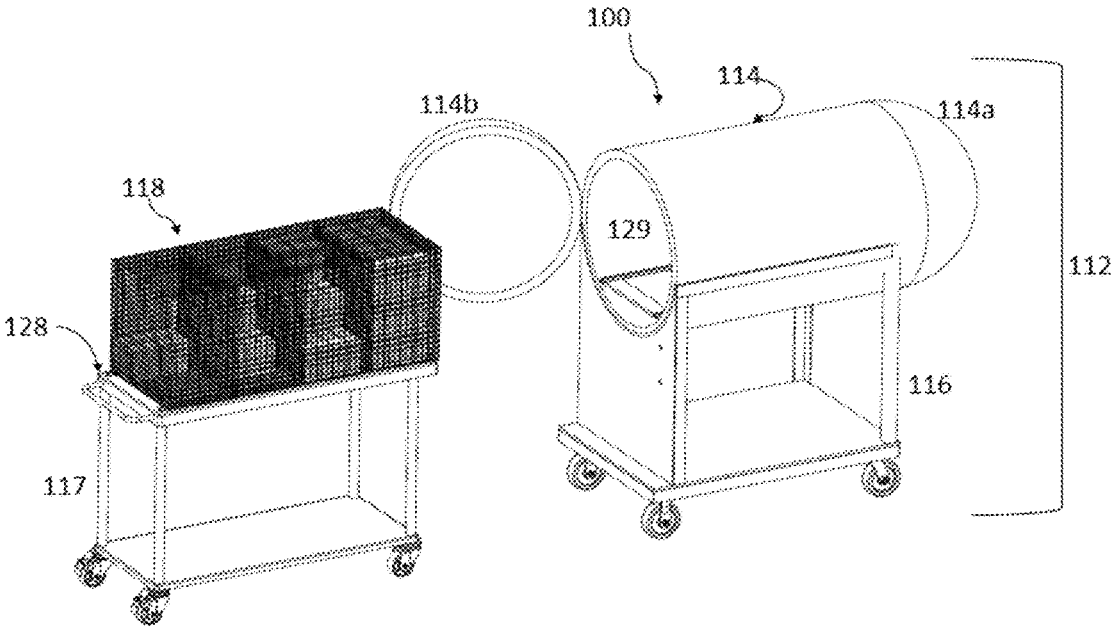
FIGS. 2A and 2B show an exemplary supercritical fluid chamber according to an embodiment of the invention.
Figure 2B:
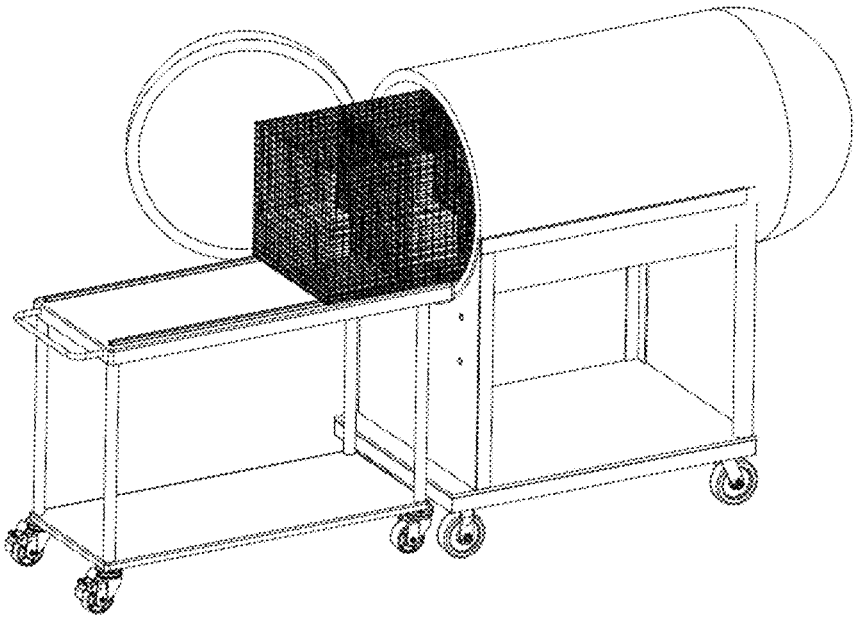

FIGS. 2A and 2B illustrate a chamber 100 for cleaning and reversing banknote limpness, according to an exemplary embodiment. The chamber 100 for cleaning and reversing banknote limpness may include a chamber structure 112, which may include a holding structure 114 having a first end 114*a* and a second end 114*b* and a base portion 116. At least one of the first and second ends 114*a*, 114*b* may be configured to transition between an open configuration and a closed configuration.

The chamber 100 of may further include a basket 118 configured to maintain stacks of banknotes in a desired position within the holding structure 114. In some embodiments, the basket 118 may be integral with at least a portion of the holding structure. For example, in some embodiments, the basket 118 may be configured to slide in and out of the holding structure 114 while connected to a track in the holding structure. Alternatively, as illustrated in FIGS. 2A and 2B, the basket 118 may not be integral with the holding structure. That is, the basket 118 may be configured to transition between a position within the holding structure 114 (FIG. 2B) and a position outside of the holding structure 114 (FIG. 2A) in which the basket 118 may no longer be in contact with the holding structure 114.

The chamber 100 may include any mechanisms known to those skilled in the art configured to aid in the transitioning of the basket 118 in and out of the holding structure 114. For example, as illustrated in FIGS. 2A and 2B, a cart 117 may be used to facilitate the transitioning. The cart 117 may be sized, shaped, and configured to support the basket 118 with stacks of banknotes therein and may be movable relative to the chamber structure 112. The cart 117 may include a height that may be substantially the same as the height of the base portion 116 of the chamber structure 112 so that a device user does not have to vertically move the basket 118 as it is transitioned in and out of the holding structure 114. Additionally, the cart 117 and an interior portion 129 of the holding structure may each include at least one rail 128. A corresponding rail (not shown) may be located on a bottom surface of the basket 118 such that the basket 118 may be configured to slide along each of the interior surface 129 of the holding structure and a top surface of the cart 117 as the basket 118 is transitioned in and out of the holding structure 114.

In some embodiments, cleaning and reversal of banknote limpness may be carried out on banknotes that are positioned individually within the chamber 100. Alternatively, or in addition, in some embodiments the cleaning and reversal of banknote limpness may be carried out on banknotes that are positioned in stacks of multiple banknotes within the chamber. Each stack of banknotes may include any number of banknotes known to those skilled in the art so long as each banknote in the stack may be cleaned and/or the limpness of each banknote in the stack may be reversed. In one embodiment, for example, each stack of banknotes may include approximately 100 banknotes. In some embodiments, the stacks of banknotes may be positioned in the chamber 100 individually. Alternatively, in some embodiments, as illustrated in FIGS. 2A and 2B, the stacks of banknotes may be positioned in the chamber 100 individually or in bundles (i.e., multiple stacks at one time).

Figure 3:
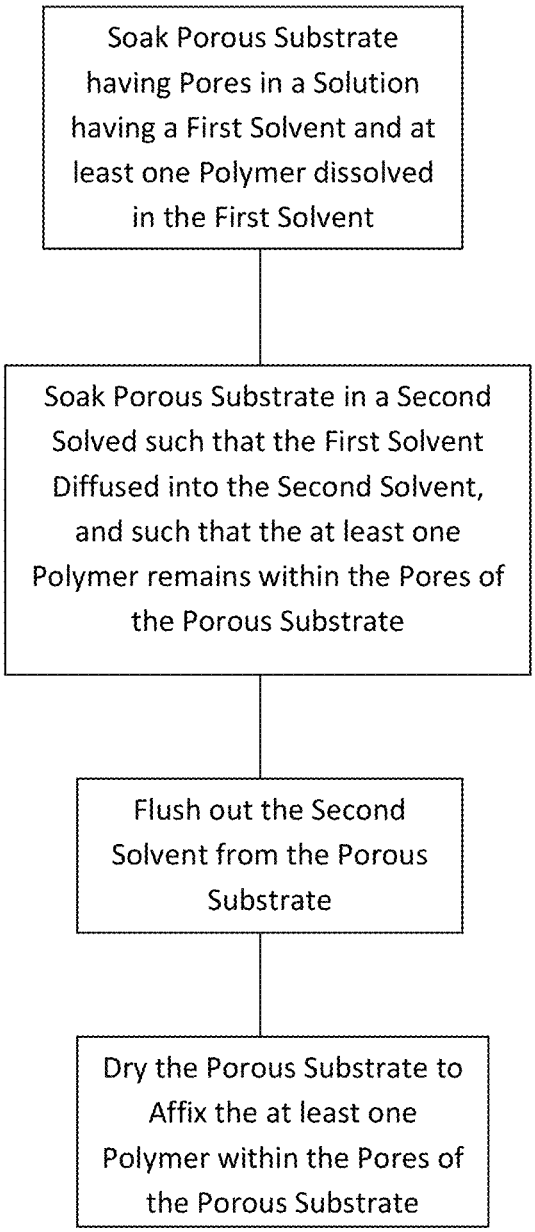
FIG. 3 shows a flow chart illustrating a method for reversing the limpness of a porous substrate.

FIG. 3 is a flow chart illustrating a method for reversing the limpness of a porous substrate, according to an exemplary embodiment. The porous substrate may be any substrate known to those skilled in the art that may require strengthening, including but not limited to, paper, secure documents, and banknotes. Most banknote substrates are porous. Generally, limpness of porous substrates may be a result of expansion of the pore in a porous substrate due to mechanical wear. Accordingly, embodiments of the methods disclosed impregnate the expanded pores with a desired material in order to reverse limpness of the porous substrate.

FIG. 3 illustrates that the method may include soaking the porous substrate in a first solution at a specific temperature. The first solution may include a first solvent and at least one polymer dissolved in the solvent. The polymer may be any high molecular-weight polymer known to those skilled in the art that may be configured to impregnate the pore of a porous substrate. For example, in some embodiments, the high molecular-weight polymer may have a molecular weight of approximately 8,000,000. The high molecular-weight polymer may include, but is not limited to, polyvinyl alcohol (PVA), polyethylene oxide (PEO), polyethylene glycol (PEG), or combinations thereof. The first solvent may be any solvent known to those skilled in the art that may be configured to be diffused out of the porous substrate, including but not limited to, ethanol and/or an ethanol-water combination. The temperature of the first solvent may be any temperature configured to enable the porous substrate to soak up the first solvent and the at least one polymer. For example, in some embodiments, the first solvent may be at a temperature of approximately 50 degrees Celsius.

The method further includes the step of diffusing the first solvent from the porous substrate by soaking the porous substrate in a second solvent at a specific temperature. The second solvent may be any solvent configured to allow the first solvent to diffuse therein, such that the first solvent may be substantially removed from the porous substrate. The second solvent can also be the first solvent but at a different temperature and pressure, such that the polymer exhibits a different solubility. The second solvent may be configured such that the high molecular-weight polymer is not soluble therein. In some embodiments, for example, the second solvent may include, but is not limited to, water, acetone, a supercritical fluid, or combinations thereof. The temperature of the second solvent may be any temperature configured to enable the first solvent to diffuse therein. For example, in some embodiments, the temperature of the second solvent may be 25 degrees Celsius. In other embodiments, the temperature of the second solvent may be 35 degrees Celsius.

As illustrated in FIG. 3, after the step of soaking the porous substrate in the second solvent is completed, the second solvent may be flushed out of the porous substrate such that the at least one polymer may be configured to remain in and be affixed to the pores of the porous substrate by drying therein. For example, in some embodiments the second solvent may be flushed out by evaporation. In other embodiments, the second solvent may be soluble in a supercritical fluid, and the supercritical fluid may be used to flush out the second solvent.

The method for reversing limpness of a porous substrate may be enhanced by supercritical fluid cleaning of the porous substrate to remove contaminants. The supercritical fluid cleaning may be done before or after the method for reversing limpness. In some embodiments, supercritical fluid cleaning may be combined therewith. In those embodiments, for example, the second solvent may be a supercritical fluid that may be configured such that the first solvent may be soluble therein.

Figure 4A:
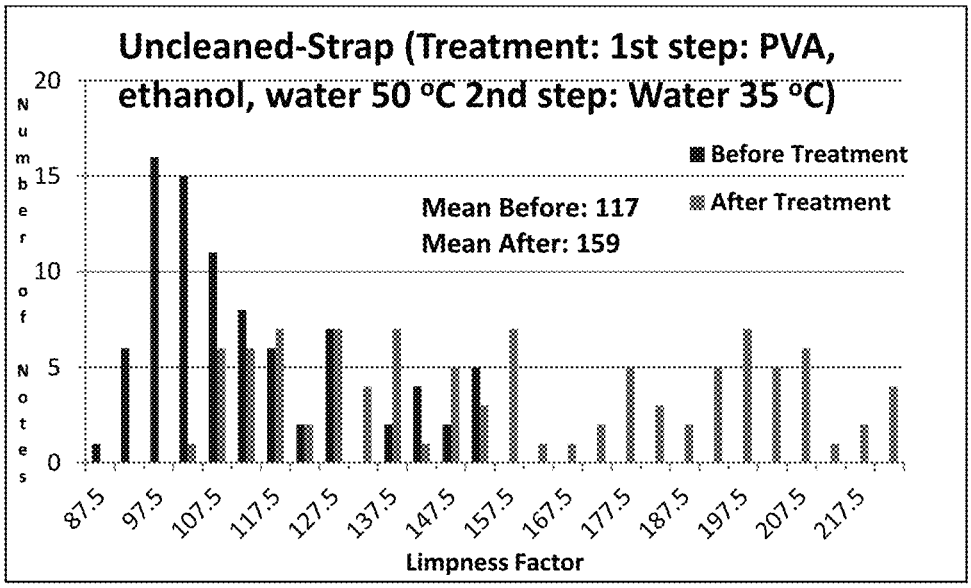
FIGS. 4A and 4B show limpness data of banknotes before and after exposure to a method of reversing banknote limpness, according to an embodiment of the invention.
Figure 4B:
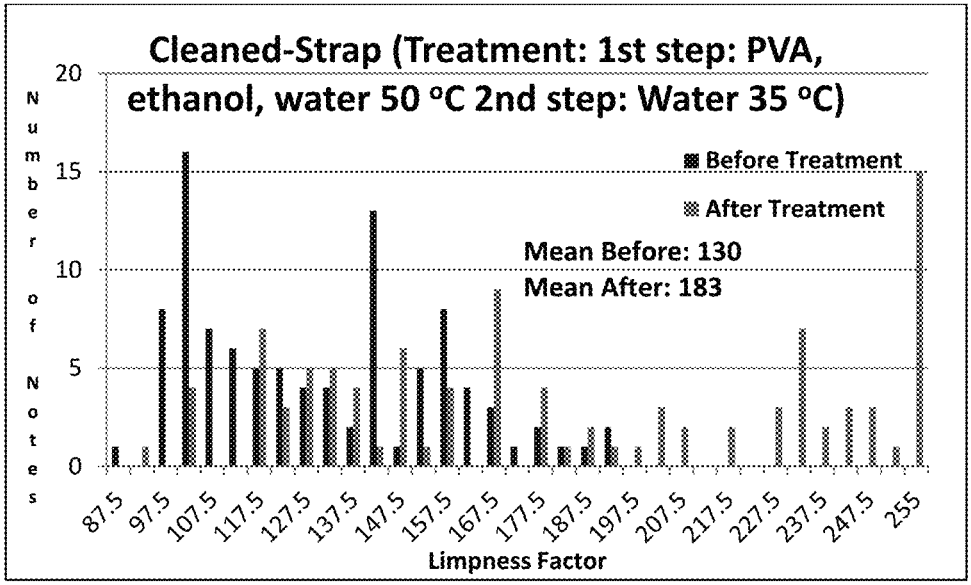

FIGS. 4A, 4B, 5A, and 5B illustrates data corresponding to banknotes before and after being exposed to the method for reversing banknote limpness. In the embodiments of FIGS. 4A and 4B, the polymer included PVA, the first solvent included ethanol and water at a temperature of 50 degrees Celsius, and the second solvent included water at 35 degrees Celsius. The banknotes in FIG. 4A were not cleaned prior to the treatment, whereas the banknotes in FIG. 4B were cleaned prior to treatment.

Figure 5A:
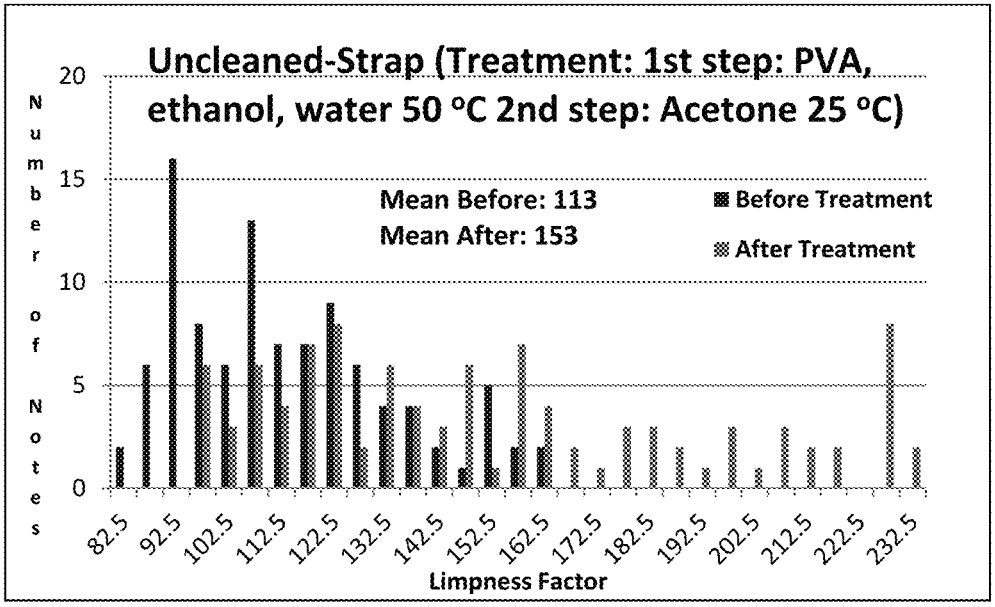
FIGS. 5A and 5B show limpness data of banknotes before and after exposure to a method of reversing banknote limpness, according to another embodiment of the invention.
Figure 5B:
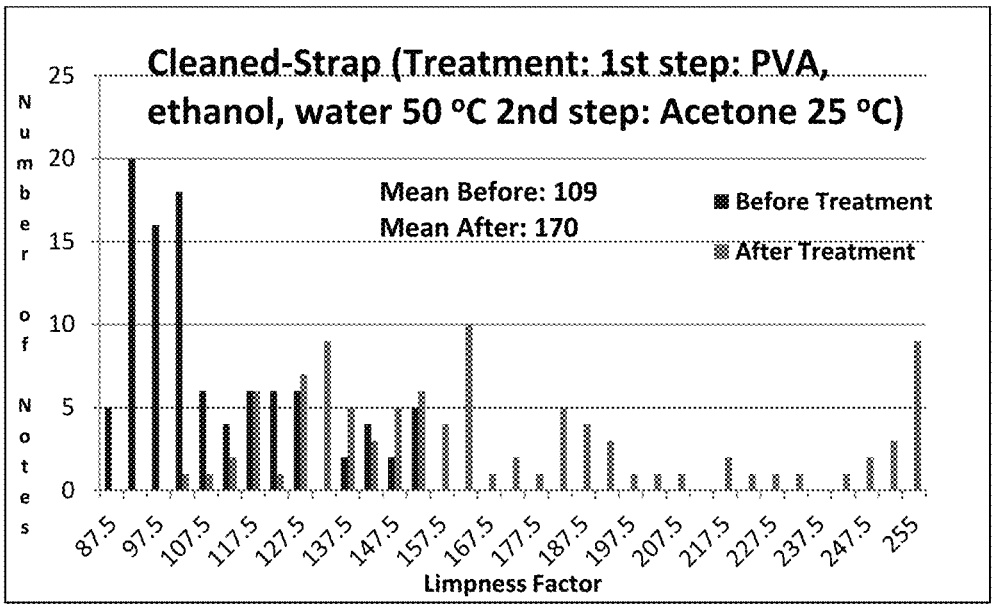
Figure 6A:
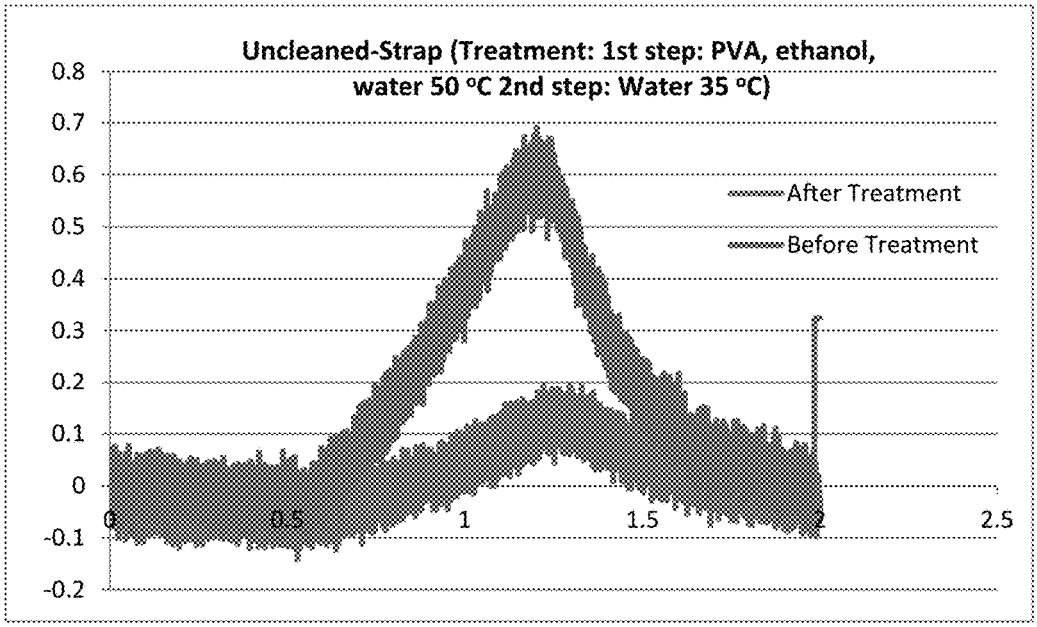
FIGS. 6A and 6B show porosity data of the banknotes in FIGS. 4A and 4B, respectively, before and after exposure to the method of reversing banknote limpness.
Figure 6B:
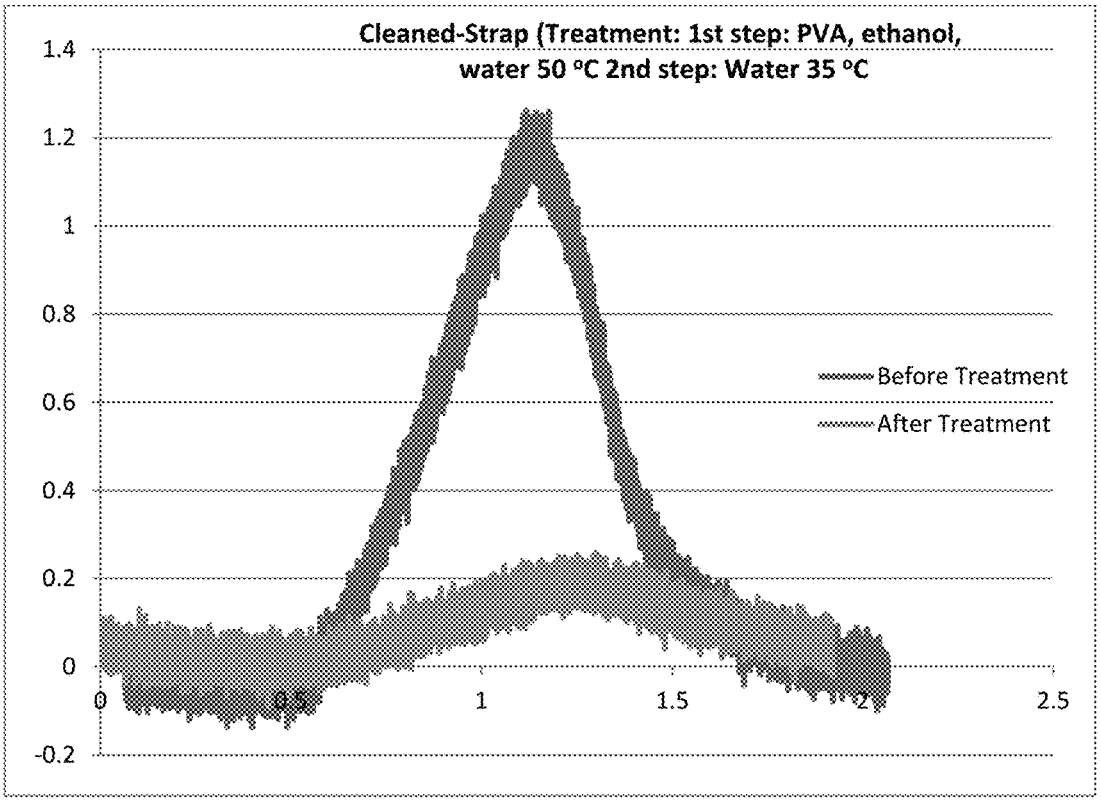
Figure 7A:
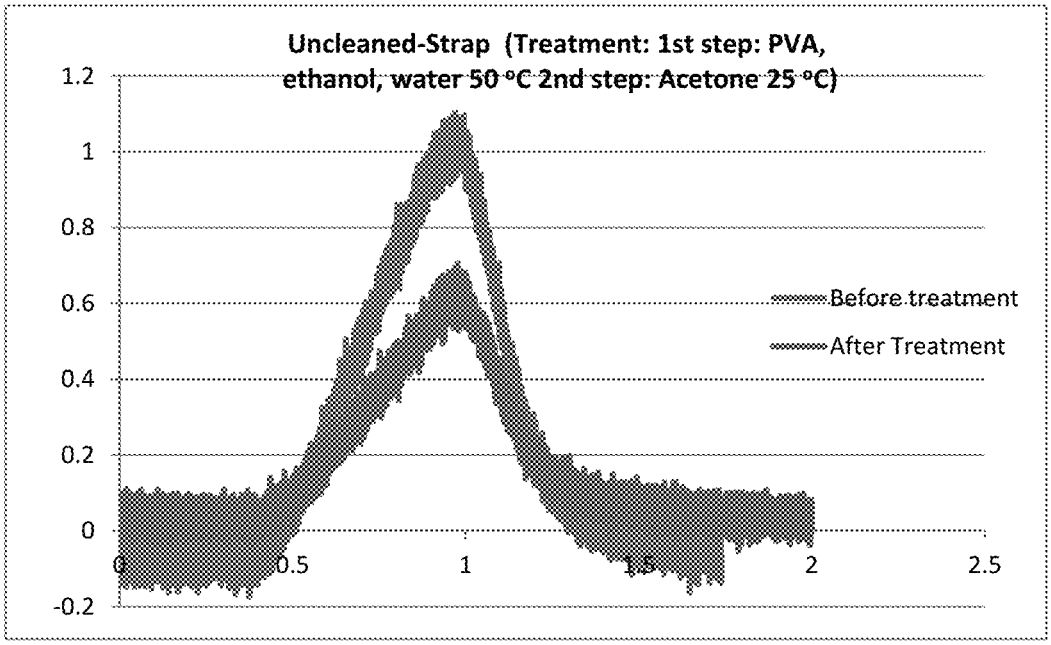
FIGS. 7A and 7B show porosity data of the banknotes in FIGS. 5A and 5B, respectively, before and after exposure to the method of reversing banknote limpness.
Figure 7B:
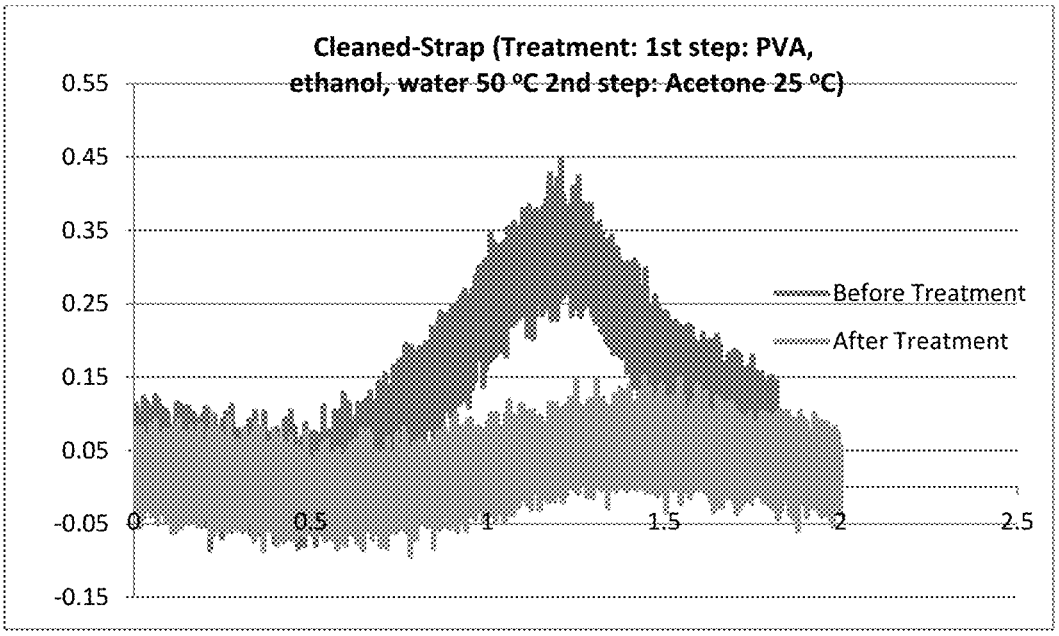

In the embodiments of FIGS. 5A and 5B, the polymer included PVA, the first solvent included ethanol and water at a temperature of 50 degrees Celsius, and the second solvent included acetone at 25 degrees Celsius. The banknotes in FIG. 5A were not cleaned prior to the treatment, whereas the banknotes in FIG. 5B were cleaned prior to treatment. As illustrated in each of FIGS. 4A, 4B, 5A, and 5B, the mean limpness factor of all the banknotes that underwent the method for reversing banknote limpness was higher after the treatment. The limpness factor is a measure of limpness known to those of skill in the art.

Banknote limpness has been shown to be directly related to changes in the porosity of the banknote with mechanical wear. The porosity of the banknotes increases with use and manifests itself in a lower effective elastic constant. The graphs in FIGS. 6A, 6B, 7A, and 7B illustrate the change in porosity of the banknotes before and after the treatments identified in FIGS. 4A, 4B, 5A, and 5B, respectively. Consistent with the higher limpness factors discussed above, the porosity of the banknotes decreased after treatment.

The embodiments and examples above are illustrative, and many variations can be introduced to them without departing from the spirit of the disclosure or from the scope of the appended claims. For example, elements and/or features of different illustrative and exemplary embodiments herein may be combined with each other and/or substituted with each other within the scope of this disclosure. The objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

What is claimed is:

1. A method for enhancing the structural strength of a porous substrate of a first material having pores therein, comprising:

soaking the porous substrate in a solution having a first solvent and at least one polymer comprising a second material distinct from the first material dissolved in the first solvent at a specific temperature and pressure, such that the solution is deposited within pores of the porous substrate;

soaking the porous substrate in a second solvent, such that the first solvent diffuses into the second solvent, and such that the at least one polymer remains within the pores of the porous substrate; and flushing out the second solvent from the porous substrate;

wherein a polymer of the at least one polymer is polyvinyl alcohol (PVA), polyethylene oxide (PEO), or polyethylene glycol (PEG).

2. The method of claim 1, wherein the second solvent is the first solvent at a different temperature and pressure such that the polymer exhibits a different solubility.

3. The method of claim 1, wherein the porous substrate is a document including a security feature.

4. The method of claim 3, wherein the document is a banknote.

5. The method of claim 1, further comprising cleaning the porous substrate with a supercritical fluid.

6. The method of claim 1, wherein the first solvent includes ethanol.

7. The method of claim 1, wherein the second solvent includes water, acetone, or a supercritical fluid.

8. The method of claim 7, wherein the second solvent includes a supercritical fluid.

9. The method of claim 1, wherein the polymer is a high molecular-weight polymer.

10. The method of claim 1, wherein flushing out the second solvent includes evaporating.

11. The method of claim 1, wherein flushing out the second solvent includes treating the porous substrate with a supercritical fluid.

12. A method for cleaning and enhancing the structural strength of a document having a security feature, the document including a porous substrate of a first material having pores therein, comprising:

soaking the document in a solution having a first solvent and at least one polymer comprising a second material distinct from the first material dissolved in the first solvent at a specific temperature and pressure, such that the solution is deposited within pores of the porous substrate;

soaking the document in a second solvent, such that the first solvent diffuses into the second solvent, and such that the at least one polymer remains within the pores of the document;

flushing out the second solvent from the document; and cleaning the document with a supercritical fluid, such that the security feature is not damaged;

wherein a polymer of the at least one polymer is polyvinyl alcohol (PVA), polyethylene oxide (PEO), or polyethylene glycol (PEG).

13. The method of claim 12, wherein the second solvent is the first solvent at a different temperature and pressure such that the polymer exhibits a different solubility.

14. The method of claim 12, wherein the step of cleaning the document occurs prior to soaking the document in the solution.

15. The method of claim 13, wherein the step of cleaning the document occurs after soaking the document in the solution.

16. The method of claim 12, wherein the second solvent is the supercritical fluid, and wherein the step of cleaning the document occurs when the document is disposed in the supercritical fluid.

17. The method of claim 12, wherein the first solvent includes ethanol.

18. The method of claim 12, wherein the second solvent includes water or acetone.

19. The method of claim 12, wherein the polymer is a high molecular-weight polymer.

20. The method of claim 12, wherein flushing out the second solvent includes evaporating or treating the porous substrate with a supercritical fluid.

* * * * *